US009771854B2

(12) United States Patent
Sakurai et al.

(10) Patent No.: US 9,771,854 B2
(45) Date of Patent: Sep. 26, 2017

(54) ENGINE WATER-COOLING DEVICE

(71) Applicant: KUBOTA Corporation, Osaka-shi, Osaka (JP)

(72) Inventors: Naoya Sakurai, Sakai (JP); Hideyuki Koyama, Sakai (JP); Hideyuki Goto, Sakai (JP); Kentaro Nagai, Sakai (JP); Tadashi Nakano, Sakai (JP)

(73) Assignee: KUBOTA Corporation, Osaka-shi, Osaka (JP)

( * ) Notice: Subject to any disclaimer, the term of this patent is extended or adjusted under 35 U.S.C. 154(b) by 162 days.

(21) Appl. No.: 14/842,520

(22) Filed: Sep. 1, 2015

(65) Prior Publication Data

US 2016/0090895 A1 Mar. 31, 2016

(30) Foreign Application Priority Data

Sep. 29, 2014 (JP) ..... 2014-198030

(51) Int. Cl.

| | |
|---|---|
| ***F02F 1/10*** | (2006.01) |
| ***F02F 1/14*** | (2006.01) |
| ***F01P 5/10*** | (2006.01) |
| ***F02F 1/36*** | (2006.01) |
| ***F01P 7/16*** | (2006.01) |
| ***F01P 5/12*** | (2006.01) |
| ***F01P 11/04*** | (2006.01) |
| ***F01P 1/06*** | (2006.01) |
| ***F01P 5/02*** | (2006.01) |
| *F01P 3/02* | (2006.01) |

(52) U.S. Cl.

CPC *F01P 7/16* (2013.01); *F01P 1/06* (2013.01); *F01P 3/02* (2013.01); *F01P 5/02* (2013.01); *F01P 5/10* (2013.01); *F01P 5/12* (2013.01); *F01P 11/04* (2013.01); *F01P 2003/024* (2013.01); *F01P 2003/025* (2013.01)

(58) Field of Classification Search

CPC ..... F01P 7/16; F01P 1/06; F01P 3/02; F01P 5/10; F01P 5/02; F01P 2003/025; F01P 2003/024; F01P 5/12; F01P 11/04

USPC ..... 123/41.01, 41.62, 41.44, 41.67, 41.72, 123/41.79, 41.82 R

See application file for complete search history.

(56) References Cited

U.S. PATENT DOCUMENTS

| | | | |
|---|---|---|---|
| 1,519,155 | A | 12/1924 | Moorhouse |
| 5,970,928 | A | 10/1999 | Smietanski et al. |

FOREIGN PATENT DOCUMENTS

| | | | |
|---|---|---|---|
| EP | 1143124 | A2 | 10/2001 |
| EP | 1143124 | A3 | 10/2003 |
| JP | 2001098944 | A | 4/2001 |

OTHER PUBLICATIONS

Extended Search Report issued Feb. 5, 2016 in EP Application No. 15178376.8.

*Primary Examiner* — Syed O Hasan

(74) *Attorney, Agent, or Firm* — Panitch Schwarze Belisario & Nadel LLP

(57) ABSTRACT

There is provided an engine water-cooling device that can increase warming-up efficiency of an engine. The engine water-cooling device includes a thermostat housing that houses a thermostat. The thermostat housing is mounted to a front wall of a cylinder head in one side portion in a width direction of the cylinder head. A cooling water pump is mounted to a front wall of a cylinder block in a central portion in a width direction of the cylinder block. A bypass passage includes an intra-head bypass passage in the cylinder head, and the intra-head bypass passage includes a width-direction passage portion extending from a position behind the thermostat housing to a position behind and above the cooling water pump.

20 Claims, 4 Drawing Sheets

ENGINE WATER-COOLING DEVICE

BACKGROUND OF THE INVENTION (1) Field of the Invention

The present invention relates to an engine water-cooling device.

(2) Description of Related Art

Conventionally, as an engine water-cooling device, there is a device in which a bypass passage includes only a bypass pipe exposed outside an engine.

In the conventional engine water-cooling device, when the engine cooling water passes through the bypass passage, heat of the engine cooling water radiates. A water temperature of the engine cooling water reduces, and the warming-up efficiency of the engine is low.

SUMMARY OF THE INVENTION

An object of the present invention is to provide an engine water-cooling device that can increase warming-up efficiency of an engine.

Matters specifying the present invention are as follows.

An engine water-cooling device including: an intra-head cooling water jacket in a cylinder head; a thermostat; a bypass passage; a radiator; and a cooling water pump, and configured such that engine cooling water in the intra-head cooling water jacket flows back to the cooling water pump via the bypass passage bypassing the radiator and when a water temperature of the engine cooling water detected by the thermostat exceeds a predetermined value, the thermostat causes the engine cooling water in the intra-head cooling water jacket to flow back to the cooling water pump via the radiator, wherein the engine water-cooling device includes a thermostat housing that houses the thermostat, the thermostat housing is mounted to a front wall of the cylinder head in one side portion in a width direction of the cylinder head, the cooling water pump is mounted to a front wall of a cylinder block in a central portion in a width direction of the cylinder block, the bypass passage includes an intra-head bypass passage in the cylinder head, and the intra-head bypass passage includes a width-direction passage portion extending from a position behind the thermostat housing to a position behind and above the cooling water pump.

The invention exerts the following effect.

The engine cooling water passing through the relatively long width-direction passage portion receives heat from the cylinder head. Reduction in the water temperature of the engine cooling water is suppressed, and it is possible to increase the warming-up efficiency of the engine.

BRIEF DESCRIPTION OF THE DRAWINGS

FIGS. 1A and 1B are schematic diagrams for explaining an engine water-cooling device according to an embodiment of the present invention, wherein FIG. 1A is a front view of an engine and FIG. 1B is a side view of the engine;

FIGS. 2A and 2B are enlarged views of an essential portion of the engine water-cooling device according to the embodiment of the present invention, wherein FIG. 2A is a front view and FIG. 2B is a sectional view taken along line B-B in FIG. 2A;

FIGS. 3A and 3B are diagrams for explaining a variation of a thermostat housing used in the embodiment of the present invention, wherein FIG. 3A is a vertical sectional side view and FIG. 3B is a sectional view taken along line B-B in FIG. 3A; and FIGS. 4A and 4B are enlarged views of an essential portion for explaining a variation of a bottom bypass passage used in the embodiment of the present invention, wherein FIG. 4A is a front view and FIG. 4B is a sectional view taken along line B-B in FIG. 4A.

DETAILED DESCRIPTION OF PREFERRED EMBODIMENT

FIGS. 1A to 4B are diagrams for explaining an engine water-cooling device according to an embodiment of the present invention. In the embodiment, a water-cooling device of a vertical multicylinder diesel engine will be described.

A general outline of the engine is as follows.

Figure 1B:
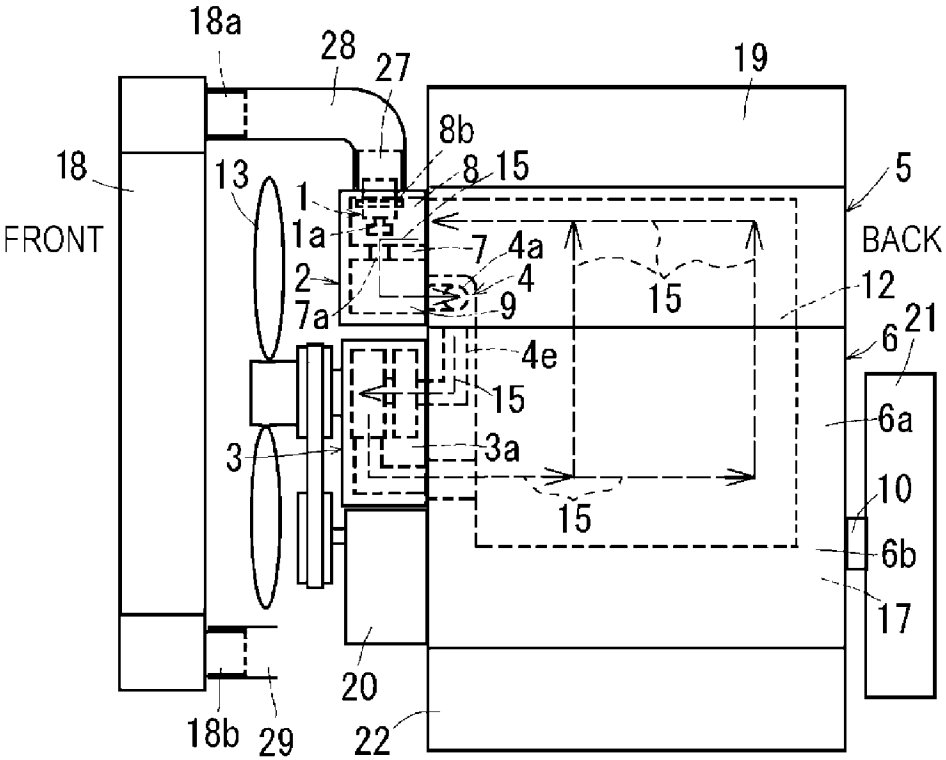
Figure 1A:
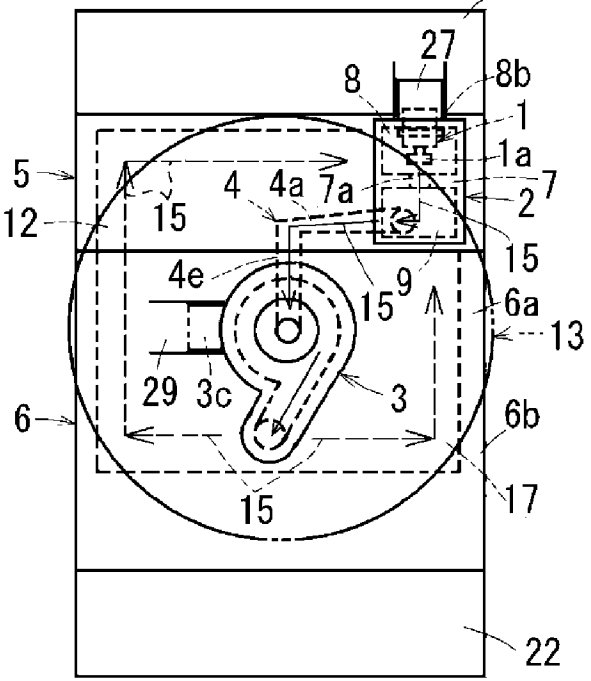

As shown in FIGS. 1A and 1B, a cylinder head (5) is mounted to an upper portion of a cylinder block (6). A cylinder head cover (19) is mounted to an upper portion of the cylinder head (5). A timing transmission case (20) is mounted to a front portion of the cylinder block (6). An engine cooling fan (13) is disposed in front of the timing transmission case (20). A flywheel (21) is disposed behind the cylinder block (6), and an oil pan (22) is mounted to a lower portion of the cylinder block (6).

The cylinder block (6) is a casting having an upper cylinder portion (6*a*) and a lower crankcase (6*b*) integrated with each other.

In the embodiment, a direction in which a crankshaft (10) extends is defined as a front-back direction, one side of the front-back direction is defined as the front, and the other side is defined as the back.

A general outline of the engine water-cooling device is as follows.

As shown in FIG. 1B, the water-cooling device includes an intra-head cooling water jacket (12) in the cylinder head (5), a thermostat (1), a bypass passage (4), a radiator (18), and a cooling water pump (3).

The water-cooling device is configured such that engine cooling water (15) in the intra-head cooling water jacket (12) flows back to the cooling water pump (3) via the bypass passage (4) bypassing the radiator (18) and when a temperature of the engine cooling water (15) detected by the thermostat (1) exceeds a predetermined value, the thermostat (1) causes the engine cooling water (15) in the intra-head cooling water jacket (12) to flow back to the cooling water pump (3) via the radiator (18).

Details of the water-cooling device are as follows.

Figure 2B:
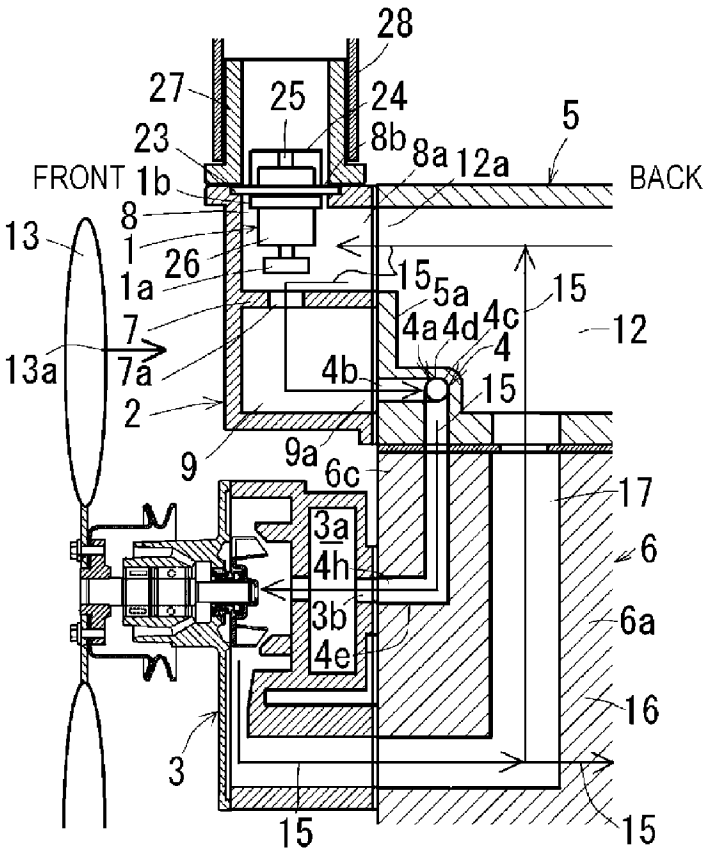

As shown in FIG. 2B, in the water-cooling device, an intra-block cooling-water jacket (17) is formed around cylinders (16) in the cylinder block (6), and the intra-block cooling-water jacket (17) and the intra-head cooling water jacket (12) communicate with each other. The cooling water pump (3) is mounted to a front end wall (6*c*) of the cylinder block (6). As shown in FIG. 1B, the radiator (18) is disposed in front of the cylinder block (6).

Figure 2A:
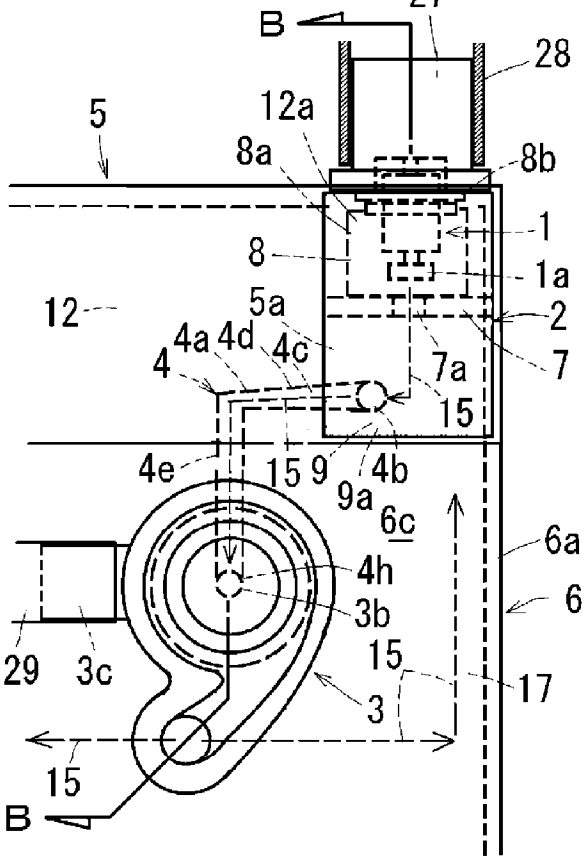

As shown in FIGS. 2A and 2B, the water-cooling device includes a thermostat housing (2) that houses the thermostat (1). The thermostat housing (2) is mounted to a front wall (5*a*) of the cylinder head (5) in one side portion in a width direction of the cylinder head (5), and the cooling water pump (3) is mounted to the front wall (6*c*) of the cylinder block (6) in a central portion in a width direction of the cylinder block (6).

The bypass passage (4) includes an intra-head bypass passage (4*a*) in the cylinder head (5), and the intra-head bypass passage (4*a*) has a width-direction passage portion (4*c*) extending from a position behind the thermostat housing (2) to a position behind and above the cooling water pump (3). For this reason, the engine cooling water (15) passing through the relatively long width-direction passage portion (4*c*) receives heat from the cylinder head (5). Reduction in the water temperature of the engine cooling water (15) is suppressed, and it is possible to increase the warming-up efficiency of the engine.

As shown in FIGS. 2A and 2B, in the water-cooling device, the thermostat (1) is of a bottom bypass type and an inside of the thermostat housing (2) is partitioned with a partition wall (7) into an upper thermostat chamber (8) and a lower bottom bypass chamber (9). A bottom bypass valve orifice (7*a*) is provided in the partition wall (7). An outlet (8*b*) to the radiator (18) opens on an upper side of the thermostat chamber (8). An inlet (8*a*) of the thermostat chamber (8) opens on a back side of the thermostat chamber (8), and an outlet (9*a*) of the bottom bypass chamber (9) opens on a back side of the bottom bypass chamber (9).

For this reason, the inside of the thermostat housing (2) can be made into a simple structure of having only the partition wall (7) including the bottom bypass valve orifice (7*a*), and it becomes easy to perform demolding and the like during casting and to manufacture the thermostat housing (2).

Further, simply mounting the thermostat housing (2) to the front wall (5*a*) of the cylinder head (5) completes the communication work between the cylinder head (5) and the thermostat housing (2).

Furthermore, the engine cooling water (15) introduced forward into the thermostat chamber (8) passes downward through the lower bottom bypass valve orifice (7*a*), reverses into a backward direction in the bottom bypass chamber (9), and smoothly passes through the thermostat housing (2) without taking a complicated meandering route. For this reason, resistance to passage of the engine cooling water (15) in the thermostat housing (2) is small, and it is possible to reduce the horsepower loss of the engine.

As shown in FIGS. 2A and 2B, in the water-cooling device, an outlet (12*a*) of the intra-head cooling water jacket (12) and an inlet (4*b*) of the bypass passage (4) open on the front wall (5*a*) of the cylinder head (5).

The thermostat (1) is housed in the thermostat chamber (8). The bottom bypass valve orifice (7*a*) is configured to be opened and closed by a bottom bypass valve (1*a*) of the thermostat (1). The outlet (12*a*) of the intra-head cooling water jacket (12) and the inlet (8*a*) of the thermostat chamber (8) overlap and communicate with each other, and the outlet (9*a*) of the bottom bypass chamber (9) and the inlet (4*b*) of the bypass passage (4) overlap and communicate with each other.

The thermostat (1) is of a bottom bypass type.

As shown in FIGS. 2A and 2B, the thermostat (1) is of a vertically-mounted wax type. A vertical needle (25) is supported on a mounting flange (23) with a stay (24) interposed therebetween. A slider (26) is fitted over the needle (25). Wax (not shown) is housed in the slider 26. A main valve (1*b*) is attached to an upper portion of the slider (26), and the bottom bypass valve (1*a*) is attached to a lower portion of the slider (26). A main valve orifice (not shown) is provided in the mounting flange (23), and the mounting flange (23) is attached to the outlet (8*b*) of the thermostat housing (2) to the radiator (18). The mounting flange (23) is sandwiched between the thermostat housing (2) and an outlet pipe (27) to the radiator (18), and mounted to the outlet (8*b*) to the radiator (18).

Note that as shown in FIG. 1B, a cooling water outlet pipe (28) is provided between the outlet pipe (27) to the radiator (18) and a radiator inlet pipe (18*a*). As shown in FIGS. 1A and 1B, a cooling water inlet pipe (29) is provided between a radiator outlet pipe (18*b*) and a suction chamber inlet pipe (3*c*) of a suction chamber (3*a*) of the cooling water pump (3).

As shown in FIG. 2B, in the thermostat (1), the wax in the slider (26) is solidified and reduced in volume when the temperature of the engine cooling water (15) in contact with the slider (26) is less than the predetermined value. For this reason, the slider (26) is retained near the outlet (8*b*) to the radiator (18), the main valve (1*b*) is closed, the bottom bypass valve (la) is opened, and the engine cooling water (15) in the intra-head cooling water jacket (12) takes a shortcut to the cooling water pump (3) via the bypass passage (4) bypassing the radiator (18). Subsequently, the engine cooling water (15) flows into the intra-block cooling-water jacket (17). Heat radiation of the engine cooling water (15) by the radiator (18) is avoided, and warming up of the engine is facilitated.

When the temperature of the engine cooling water (15) in contact with the slider (26) increases, the wax in the slider (26) becomes liquefied and increases in volume. For this reason, the slider (26) slides toward the bypass valve orifice (7*a*), the main valve (1*b*) is opened, and an opening degree of the bottom bypass valve (1*a*) reduces. The engine cooling water (15) in the intra-head cooling water jacket (12) shown in FIG. 1B circulates through the radiator (18), the cooling water pump (3), and the intra-block cooling-water jacket (17) in this order, and the heat radiation of the engine cooling water (15) by the radiator (18) is carried out.

As shown in FIGS. 2A and 2B, the intra-head bypass passage (4*a*) is led out backward from the inlet (4*b*) in the one side portion in the width direction of the cylinder head (5), led out sideways from a lead-out end toward a central portion in a width direction of the engine, and led out downward from a lead-out end. An intra-block bypass passage (4*e*) is led out further downward from a downward terminal end of the intra-head bypass passage (4*a*) and led out forward from a lead-out end. An outlet (4*h*) of the bypass passage (4) at a lead-out end communicates with an inlet (3*b*) of the suction chamber (3*a*) of the cooling water pump (3) mounted to the front wall (6*c*) of the cylinder block (6).

The outlet (4*h*) of the bypass passage (4) and the inlet (3*b*) of the suction chamber (3*a*) of the cooling water pump (3) overlap and communicate with each other.

Next, a variation of the thermostat housing (2) shown in FIGS. 3A and 3B will be described.

Figure 3B:
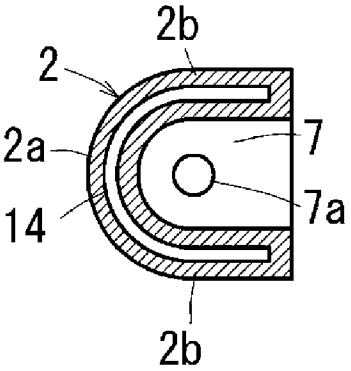
Figure 3A:
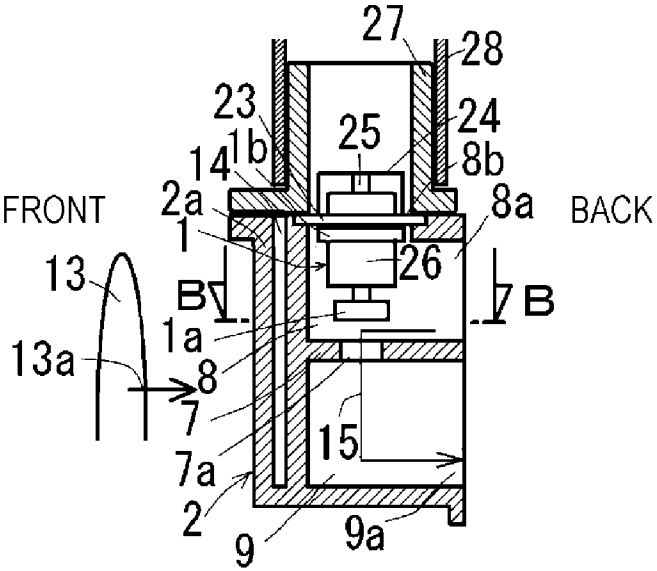

As shown in FIG. 3A, in this variation, an engine cooling fan (13) is disposed in front of a thermostat housing (2) and configured such that engine cooling air (13*a*) is blown backward from the engine cooling fan (13), and a heat insulating layer (14) is formed in a front peripheral wall (2*a*) of the thermostat housing (2). For this reason, the engine cooling water (15) passing through the thermostat housing (2) is less likely to be cooled by engine cooling air (13*a*) blowing against the front peripheral wall (2*a*) of the thermostat housing (2), and it is possible to increase the warming-up efficiency of the engine.

The heat insulating layer (14) is formed by a hollow air space in the front peripheral wall (2*a*) of the thermostat housing (2). For this reason, there is no fear of heat deterioration of the heat insulating layer (14) and it is possible to maintain a high heat insulating property of the heat insulating layer (14) for a long period.

As shown in FIG. 3B, the heat insulating layer (14) is formed continuously in the front peripheral wall (2*a*) and left and right opposite peripheral walls (2*b*), (2*b*) of the thermostat housing (2).

An upper face of the heat insulating layer (14) opens and this opening is covered with a flange of a main outlet pipe (27).

As shown in FIG. 2A, a ceiling face (4*d*) of a width-direction passage portion (4*c*) slopes upward toward a position behind the thermostat housing (2).

In other words, the ceiling face (4*d*) of the width-direction passage portion (4*c*) slopes upward toward a lead-out end of a portion led out backward from an inlet (4*b*) of an intra-head bypass passage (4*a*).

For this reason, bubbles of steam generated in the width-direction passage portion (4*c*) by the heat received from the cylinder head (5) are released to the thermostat housing (2) along the ceiling face (4*d*) of the width-direction passage portion (4*c*), and the steam is less likely to be entrapped in the width-direction passage portion (4*c*). For this reason, entry of the heat from the cylinder head (5) to the engine cooling water (15) passing through the width-direction passage portion (4*c*) is not obstructed by the steam entrapment. Reduction in the water temperature of the engine cooling water (15) is suppressed, and it is possible to maintain a high warming-up efficiency of the engine.

As shown in FIGS. 2A and 2B, a bypass passage (4) includes an intra-block bypass passage (4*e*) in a cylinder block (6) and the intra-block bypass passage (4*e*) communicates with the intra-head bypass passage (4*a*). For this reason, the engine cooling water (15) passing through the intra-block bypass passage (4*e*) receives heat from the cylinder block (6). Reduction in the water temperature of the engine cooling water (15) is suppressed, and it is possible to increase the warming-up efficiency of the engine.

The bypass passage (4) is formed continuously by the intra-head bypass passage (4*a*) and the intra-block bypass passage (4*e*) and is not exposed outside an engine.

Next, a variation of the bypass passage (4) shown in FIGS. 4A and 4B will be described.

Figure 4B:
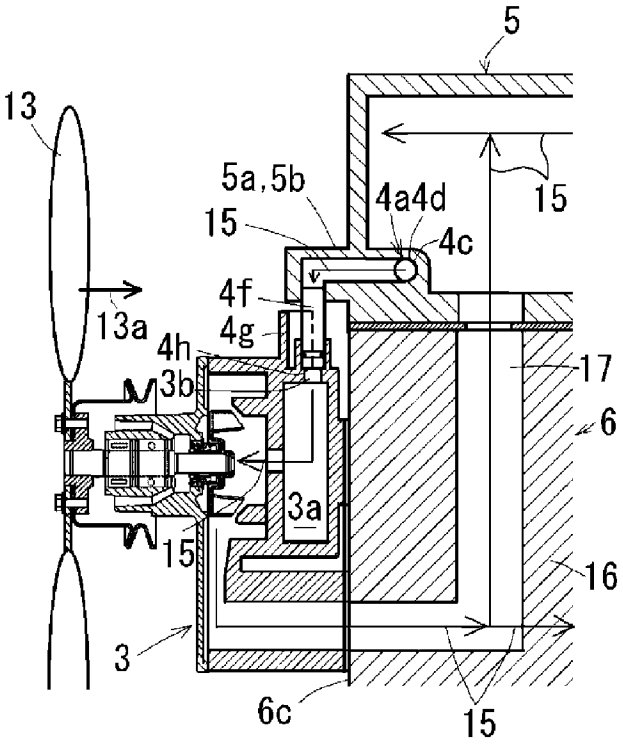
Figure 4A:
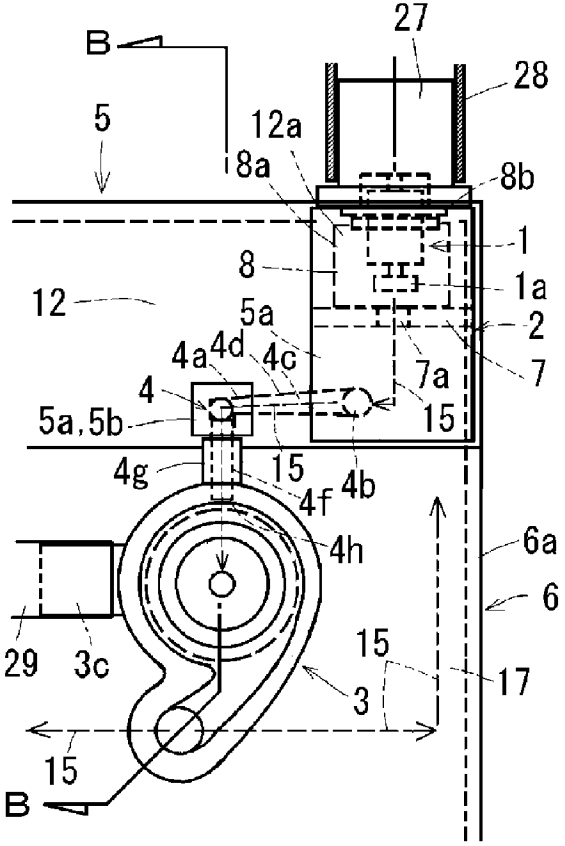

A bypass passage (4) shown in FIGS. 4A and 4B includes a bypass passage (4*f*) outside an engine and the bypass passage (4*f*) outside the engine communicates with an intra-head bypass passage (4*a*).

The bypass passage (4*f*) outside the engine is a metal pipe provided between a cylinder head (5) and a cooling water pump (3), and one end portion of the bypass passage (4*f*) outside the engine is fitted in (press-fitted into) a front wall (5*a*) of the cylinder head (5). For this reason, the heat from the cylinder head (5) is transferred to the bypass passage (4*f*) outside the engine, and the engine cooling water (15) passing through the bypass passage (4*f*) outside the engine receives the heat from the cylinder head (5). Reduction in the water temperature of the engine cooling water (15) is suppressed, and it is possible to increase the warming-up efficiency of the engine.

As shown in FIG. 4B, in this variation, an engine cooling fan (13) is disposed in front of the bypass passage (4*f*) outside the engine and configured such that engine cooling air (13*a*) is blown backward from the engine cooling fan (13). An air shielding wall (4*g*) against the engine cooling air (13*a*) is provided in front of the bypass passage (4*f*) outside the engine.

For this reason, the engine cooling water (15) passing through the bypass passage (4*f*) outside the engine is less likely to be cooled by the engine cooling air (13*a*). Reduction in the water temperature of the engine cooling water (15) is suppressed, and it is possible to increase the warming-up efficiency of the engine.

A forward bulging portion (5*b*) is formed in the front wall (5*a*) of the cylinder head (5), and an upper end portion of the bypass passage (4*f*) outside the engine is press-fitted into the bulging portion (5*b*). The air shielding wall (4*g*) is led out upward from the cooling water pump (3).

What is claimed is:

1. An engine water-cooling device comprising: an intra-head cooling water jacket in a cylinder head; a thermostat; a bypass passage; a radiator; and a cooling water pump, and configured such that engine cooling water in the intra-head cooling water jacket flows back to the cooling water pump via the bypass passage bypassing the radiator and when a water temperature of the engine cooling water detected by the thermostat exceeds a predetermined value, the thermostat causes the engine cooling water in the intra-head cooling water jacket to flow back to the cooling water pump via the radiator, wherein the engine water-cooling device includes a thermostat housing that houses the thermostat, the thermostat housing is mounted to a front wall of the cylinder head in one side portion in a width direction of the cylinder head, the cooling water pump is mounted to a front wall of a cylinder block in a central portion in a width direction of the cylinder block, the bypass passage includes an intra-head bypass passage in the cylinder head, and the intra-head bypass passage includes a width-direction passage portion extending from a position behind the thermostat housing to a position behind and above the cooling water pump.

2. The engine water-cooling device according to claim 1, wherein the thermostat is of a bottom bypass type, an inside of the thermostat housing is partitioned with a partition wall into an upper thermostat chamber and a lower bottom bypass chamber, a bottom bypass valve orifice is provided in the partition wall, an outlet to the radiator opens on an upper side of the thermostat chamber, an inlet of the thermostat chamber opens on a back side of the thermostat chamber, an outlet of the bottom bypass chamber opens on a back side of the bottom bypass chamber, an outlet of the intra-head cooling water jacket and an inlet of the bypass passage open on the front wall of the cylinder head, the thermostat is housed in the thermostat chamber, the bottom bypass valve orifice is configured to be opened and closed by a bottom bypass valve of the thermostat, the outlet of the intra-head cooling water jacket and the inlet of the thermostat chamber overlap and communicate with each other, and the outlet of the bottom bypass chamber and the inlet of the bypass passage overlap and communicate with each other.

3. The engine water-cooling device according to claim 1, wherein an engine cooling fan is disposed in front of the thermostat housing and configured such that engine cooling air is blown backward from the engine cooling fan, and a heat insulating layer is formed in a front peripheral wall of the thermostat housing.

4. The engine water-cooling device according to claim 3, wherein the heat insulating layer is formed by a hollow air space in the front peripheral wall of the thermostat housing.

5. The engine water-cooling device according to claim 1, wherein a ceiling face of the width-direction passage portion slopes upward toward a position behind the thermostat housing.

6. The engine water-cooling device according to claim 1, wherein the bypass passage includes an intra-block bypass passage in the cylinder block and the intra-block bypass passage communicates with the intra-head bypass passage.

7. The engine water-cooling device according to claim 1, wherein the bypass passage includes a bypass passage outside an engine and the bypass passage outside the engine communicates with the intra-head bypass passage, the bypass passage outside the engine is a metal pipe provided between the cylinder head and the cooling water pump, and one end portion of the bypass passage outside the engine is fitted in the front wall of the cylinder head.

8. The engine water-cooling device according to claim 7, wherein the engine cooling fan is disposed in front of the bypass passage outside the engine and configured such that the engine cooling air is blown backward from the engine cooling fan, and an air shielding wall against the engine cooling air is provided in front of the bypass passage outside the engine.

9. The engine water-cooling device according to claim 2, wherein an engine cooling fan is disposed in front of the thermostat housing and configured such that engine cooling air is blown backward from the engine cooling fan, and a heat insulating layer is formed in a front peripheral wall of the thermostat housing.

10. The engine water-cooling device according to claim 9, wherein the heat insulating layer is formed by a hollow air space in the front peripheral wall of the thermostat housing.

11. The engine water-cooling device according to claim 2, wherein a ceiling face of the width-direction passage portion slopes upward toward a position behind the thermostat housing.

12. The engine water-cooling device according to claim 3, wherein a ceiling face of the width-direction passage portion slopes upward toward a position behind the thermostat housing.

13. The engine water-cooling device according to claim 9, wherein a ceiling face of the width-direction passage portion slopes upward toward a position behind the thermostat housing.

14. The engine water-cooling device according to claim 4, wherein a ceiling face of the width-direction passage portion slopes upward toward a position behind the thermostat housing.

15. The engine water-cooling device according to claim 2, wherein the bypass passage includes an intra-block bypass passage in the cylinder block and the intra-block bypass passage communicates with the intra-head bypass passage.

16. The engine water-cooling device according to claim 3, wherein the bypass passage includes an intra-block bypass passage in the cylinder block and the intra-block bypass passage communicates with the intra-head bypass passage.

17. The engine water-cooling device according to claim 9, wherein the bypass passage includes an intra-block bypass passage in the cylinder block and the intra-block bypass passage communicates with the intra-head bypass passage.

18. The engine water-cooling device according to claim 4, wherein the bypass passage includes an intra-block bypass passage in the cylinder block and the intra-block bypass passage communicates with the intra-head bypass passage.

19. The engine water-cooling device according to claim 5, wherein the bypass passage includes an intra-block bypass passage in the cylinder block and the intra-block bypass passage communicates with the intra-head bypass passage.

20. The engine water-cooling device according to claim 11, wherein the bypass passage includes an intra-block bypass passage in the cylinder block and the intra-block bypass passage communicates with the intra-head bypass passage.

* * * * *